United States Patent [19]

Roccaforte

[11] 4,201,329

[45] May 6, 1980

[54] DOUBLE CELL SLIDE DISPENSER

[75] Inventor: Harry I. Roccaforte, Western Springs, Ill.

[73] Assignee: Champion International Corporation, Stamford, Conn.

[21] Appl. No.: 22,735

[22] Filed: Mar. 22, 1979

[51] Int. Cl.[2] ..... B65D 5/72

[52] U.S. Cl. ..... 229/17 SC; 221/91; 206/620

[58] Field of Search ..... 229/17 SC, 7 SC; 221/91, 86.4; 222/144.5; 206/620, 622

[56] References Cited

U.S. PATENT DOCUMENTS

| | | | |
|---|---|---|---|
| 1,951,274 | 3/1934 | Denman | 229/7 SC |
| 2,431,744 | 12/1947 | Fessenden | 229/17 SC |
| 2,902,201 | 9/1959 | Engblom | 229/17 SC |
| 3,954,220 | 4/1976 | Foster | 206/620 X |
| 4,066,207 | 1/1978 | Jorgensen-Beck et al. | 229/7 SC X |
| 4,094,456 | 6/1978 | Roccaforte | 229/17 SC |
| 4,138,016 | 2/1979 | Roccaforte | 229/17 SC X |
| 4,141,485 | 2/1979 | Lambert | 229/17 SC |

FOREIGN PATENT DOCUMENTS

| | | | |
|---|---|---|---|
| 921524 | 3/1963 | United Kingdom | 229/17 SC |

*Primary Examiner*—Davis T. Moorhead
*Attorney, Agent, or Firm*—Evelyn M. Sommer

[57] ABSTRACT

A dispensing carton particularly adapted for use with small candies includes a pair of tubular structures parallel to each other, closed at one end while the upper portion includes a sliding tab which is disposed intermediate overlapping tabs. The upper portion includes sets of registering holes each set of registering holes registering with one of at least a pair of compartments. The sliding tab is hingedly connected to a pivotally connected portion of one end panel of the tubular carton and is so arranged not merely to facilitate the manufacture of the carton but also so that it may be moved to a position where it opens one of the compartments alone or opens the second of the compartments alone or closes both compartments.

6 Claims, 5 Drawing Figures

DOUBLE CELL SLIDE DISPENSER

The present invention relates to a new and improved reclosable dispensing carton arranged to dispense a plurality of items through different dispensing openings by utilization of the same dispensing operation and is an improvement over the invention shown in U.S. Pat. No. 4,094,456, assigned to the assignee of the present invention.

As shown in the said patent it is now known to provide a dispensing carton so arranged that the inherent resilience of the paper of the carton itself forming a slide for a pair of aligned dispensing openings may be utilized to move the slide so that an opening in the slide will be aligned with the aligned dispensing openings to permit dispensing of the articles or material within the carton. Reliance may then be placed on the resilience of the material itself to return the slide to a non-dispensing position.

The primary object of the present invention is to provide a dispensing carton having a plurality of compartments as, for instance, two compartments with a plurality of sets of aligned dispensing openings, one leading to each compartment in which a single slide having a single dispensing opening may selectively be aligned with either of the sets of dispensing openings for the two separate compartments to selectively deliver articles or materials from the said compartments.

In this novel structure as in the structure shown in the above-mentioned prior patent, the carton blank and the dispensing carton are so arranged that an overlapping arrangement of tabs is provided. The upper and lowermost tabs have registering openings therein while an intermediate closure tab is slidably mounted between said overlapping tabs.

In the case of the present invention, instead of the single set of registering openings, there is a pair of sets of registering openings each set being aligned with a different compartment within the container. The single dispensing opening in the slide is then movable to uncover either desired set of registering openings to permit dispensing from that particular section of the carton while preventing dispensing from the other section. The entire structure may be moved to a closed position in which neither of the sets of dispensing openings is available for passage of articles or materials therethrough.

The foregoing and many other objects of the present invention will become apparent from the description and drawings in which:

FIG. 1 is a plan view of a blank from which the dispensing carton of the present invention is made.

As illustrated in the Figures the dispensing carton is a reclosable carton having the improvement that it constitutes a plurality of compartments, in this instance illustrated as two compartments, with a dispensing cover which may be aligned selectively with either of the compartments and may also be moved to seal off both of the compartments. The cover essentially has three positions; one in which material or articles may be dispensed from the first compartment; the second in which material or articles may be dispensed from the second compartment; and the third in which both compartments are closed.

The reclosable dispensing carton is an elongated tubular structure having a generally rectangular cross-section including a closed bottom and a top portion which may be partially opened for dispensing the contents of the carton and reclosed for storage purposes as hereinafter described.

Figure 7:
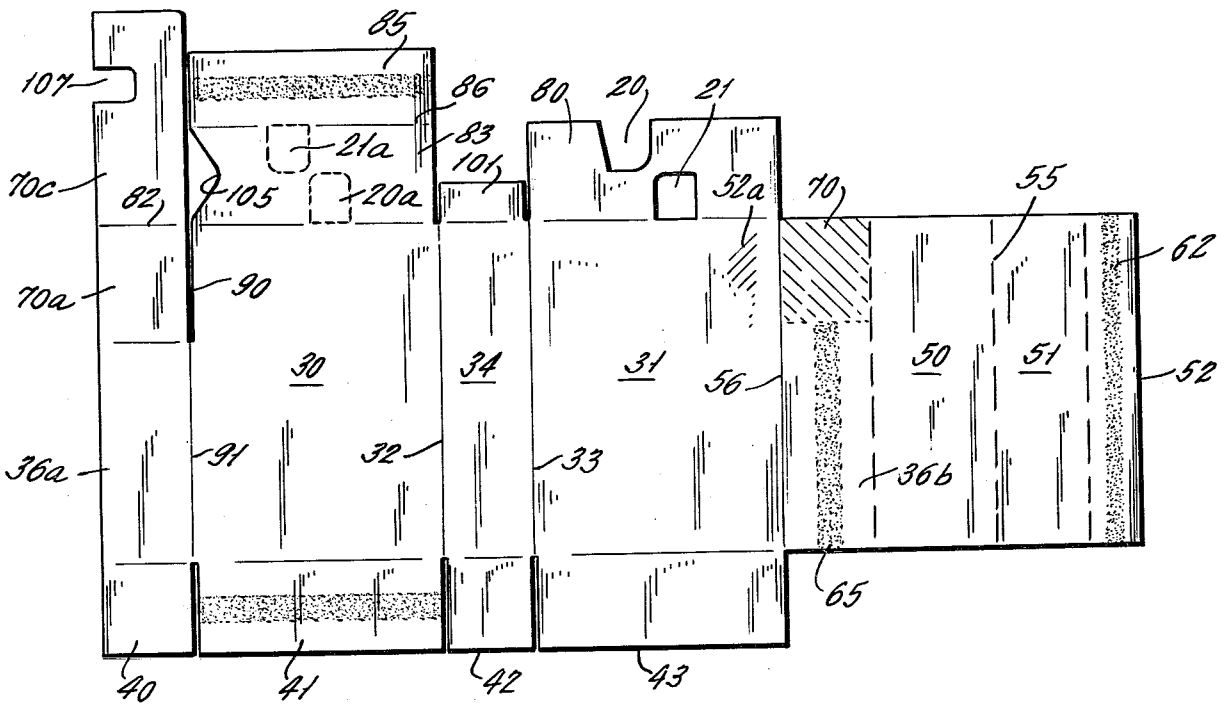
Figure 5:
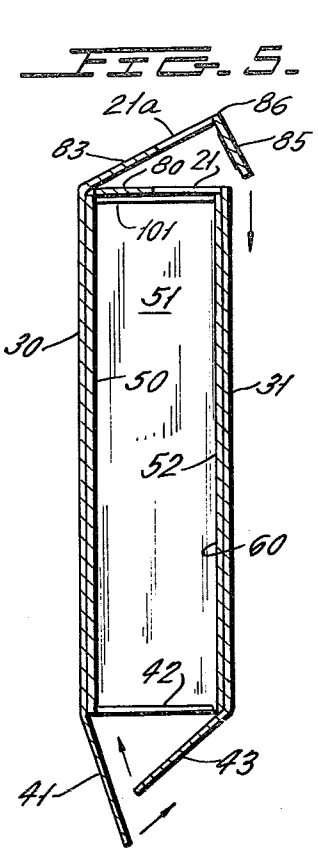
FIG. 5 is a cross-sectional view taken from line 5—5 of FIG. 2 looking in the direction of the arrows.
Figure 3:
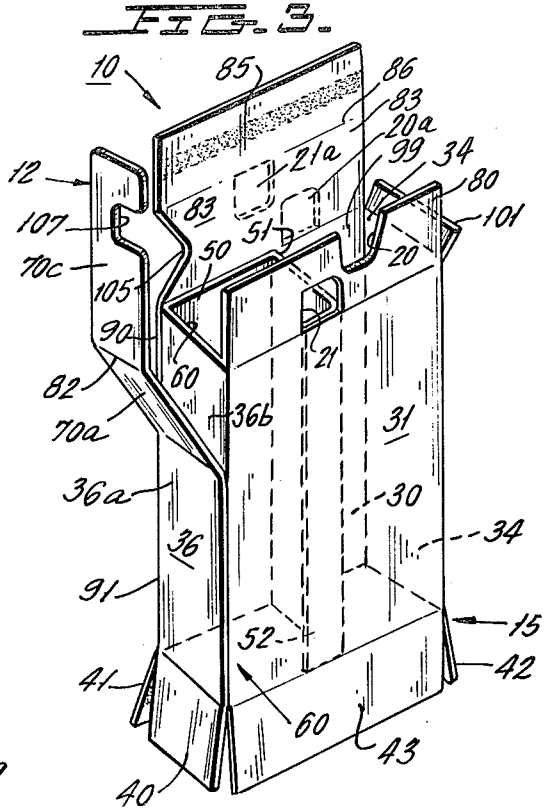
FIG. 3 is a view of the blank of FIG. 1 partially erected in order to illustrate more clearly the operation of the device.

The dispensing carton 10 shown partially in its completed form in FIG. 2, and, in its partially erected form in FIG. 3 is closed at its bottom 15 while the upper portion thereof includes reclosable registering openings 20, 21 as hereinafter described which are covered by a slidably mounted closure flap 12 which has the three positions comprising the situation in which opening 20 alone is opened or a second position where opening 21 alone is opened and a third position where neither of the openings 20 and 21 is opened.

The blank for forming the carton, as shown in FIG. 1, is provided with what is here termed a front wall 30 and a rear wall 31 hingedly connected together around the bed lines 32 and 33 by the sidewall 34. The side wall 34 is so constructed that its opposite side wall 36 is formed by the panel **36*a* of the blank and panel 36*b* of the blank. The bottom wall 15 of the carton is formed by a plurality of panels including panel 40 extending from the panel 36*a*, panel 41 extending from panel 30, panel 42 extending from panel 34 and panel 43 extending from panel 31**.

The interior of the carton is provided with two compartments as hereinbefore described. The two compartments are formed by the additional panels 50 and 51, as well as the tab 52. While the panels may be folded in any order which is desired for the particular type of structure which is to be made or which is preferred by the mechanism which actually forms the essentially tubular structure,—the preferred method of folding, as at present advised, is first to fold panel 51 normal to panel 50 around the fold line 55, then to fold the panel **36*b* around the fold line 56 with respect to the panel 31. This will bring the surface of tab 52 into engagement with the area 52*a* of panel 31 and thereby provide the compartment 60 indicated in phantom at FIG. 3. An adhesive stripe 62 is provided at that surface of the tab 52 which will engage the area 52*a* of panel 31 and thereby ensure that the compartment 60** is thereby formed.

It will thus be seen that the panel **36*b* becomes the side panel of the box opposite the panel 34. At this time the panel 30 is folded around fold line 32 with respect to the panel 34 until the inner surface of the panel 36*a* engages the outer surface of panel 36*b*. Panel 36*b* has been provided with an appropriate adhesive stripe 65 which is engaged by the material on the inner surface of panel 36*a***.

However, an area of varnish or other adhesive repellant material 70 is provided at the upper end of panel **36*b* so that any adhesive will not be effective at that point and therefore the upper section 70*a* of panel 36*a* will not be adhesively secured to the upper section 70 of panel 36*b***.

By this means a tubular carton is formed as shown in FIG. 3 in which the bottom wall 15 may now be formed from the panels 40, 41, 42 and 43 in which panels 40, 42 are folded in first, panel 43 is folded in next and panel 41 folded in last in order to adhesively secure the same to the outer surface of the panel 43 and complete the bottom of the box.

When the box has been formed in tubular form as shown in FIG. 3, the top flap 80 is folded down normal to the panel 31 the slide 70*c* is then folded around the bend line 82 into surface-to-surface engagement with the top flap 80 (flap 101 is folded next into surface-to-surface engagement with the top flap 80) and the panel 83 is then folded over the panel 70*c* in surface-to-surface engagement therewith.

Figure 2:
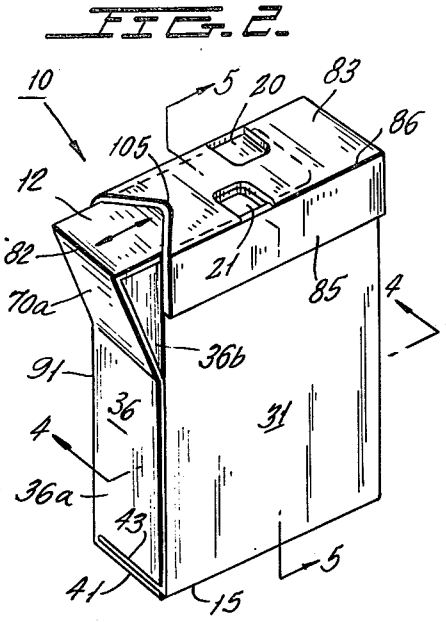
FIG. 2 is a view in perspective of the dispensing carton of FIG. 1 completed and in use.
Figure 4:
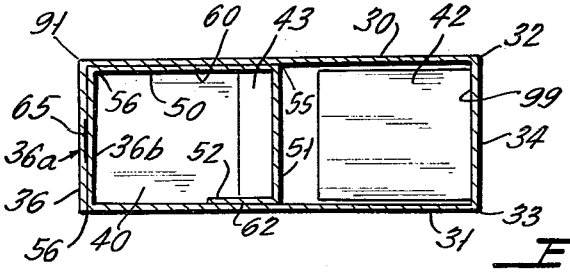
FIG. 4 is a view partly in cross-section taken from line 4—4 of FIGS. 2 and 3 looking in the direction of the arrows.

The extension 85 of panel 83 around the hinge line 86 is then folded down as shown in FIG. 2 and adhesively secured to the outer surface of panel 31 in order to complete the box. It will now be seen that the panel 70*c* connected at the fold line 82 of the panel 70*a* is slidably supported between the panels 80 and 83, but is not otherwise secured thereto.

The panel 70*a* is severed from panel 30 along the line 90 which then continues along the line 91 as a fold line in order to define the side 36*a* of the box as shown in FIG. 3.

The panels 80 and 83 are each, respectively, provided with openings 20, 21 and corresponding openings 20*a* and 21*a* which register with each other to form the final openings as shown in FIGS. 2 and 3. It will be noted that the final opening 20 registeres with the right hand compartment 99 (FIG. 3) while the final opening 21 registers with the left hand compartment 60 as shown in FIG. 3.

Panel 83 may be notched at 105 in order to provide some access for grasping the tail end 12 of section 70*c* of the closure device.

The closure device is section 70*c* the rear end of which 12 may be operated by the thumb of the user. It is connected by the hinge line 82 to panel 70*a* which is an extension of the side wall 36*a*. Section 70*c* is provided with the opening 107 which may be moved by the thumb engaging section 12 of panel 70*c* to register either with the set of openings 21 or the set of openings 20 or with neither set of openings. By this means therefore the carton may be opened for passage of articles or material from compartment 60 through the opening 21 or for the passage of articles or materials from compartment 99 through the opening 20 or may be positioned in order to lock the structure closed completely.

In the foregoing the present invention has been described solely in connection with preferred illustrative embodiments thereof. Since many variations and modifications of the present invention will now be obvious to those skilled in the art, it is preferred that the scope of the present invention be determined not by the specific disclosures herein contained but only by the appended claims.

What is claimed is:

1. A reclosable dispensing carton made of a single sheet of carton blank and comprising a plurality of elongated tubular enclosures including first and second side panels and first and second end panels for said enclosures; said enclosures extending in the same plane at the upper and lower ends thereof and a common closure for said pair of enclosures;

said enclosures being closed by a single flap at one end and a second overlapping flap, the said flaps extending from opposite walls of said carton;

a pair of sets of apertures in each of said closure flaps each set of apertures registering with one of said enclosures;

a movable closure tab extending from a side wall of said carton, said closure tab being provided with an aperture;

said closure tab aperture being arranged on movement of said closure tab parallel to the upper end of said enclosures to register selectively and successively with one of the sets of aligned openings for one enclosure then one of the sets of aligned openings for the second enclosure and then with neither of said sets of aligned openings in order to seal the said carton.

2. A reclosable dispensing carton having a plurality of compartments and made from a single blank in which a pair of dispensing enclosures is provided; one of said dispensing enclosures being formed as a tubular member having a front wall, a back wall, a side wall and an intermediate wall; the second of said enclosures being defined by the same front walls and back walls and by said intermediate wall, but also by said opposite side wall;

a common closure for said enclosures, said common closure comprising a panel extending from said opposite side wall vertically toward the top of said carton and then extending across the top of each of said enclosures; means for moving said common closure to a position where it blocks access to selected one of said pairs of enclosures and successively blocks access to both enclosures simultaneously.

3. The dispensing carton of claim 2 wherein said front wall and back wall are each provided with flaps at the top thereof;

said flaps being folded into surface-to-surface engagement with each other but being adhesively free with respect to each other.

4. The dispensing carton of claim 3 wherein said closure panel is an extension of said opposite side wall and extending between said closure flaps.

5. The dispensing carton of claim 4 having a pair of registering openings in said closure flaps with respect to each of said compartments and an opening in said movable closure flap.

6. The dispensing carton of claim 5 wherein said opening in said movable closure flap is arranged so that it may be moved successively to positions where the first enclosure is accessible, the second enclosure is accessible and neither enclosure is accessible.

* * * * *